United States Patent [19]

Bonnefoy

[11] 4,445,735

[45] May 1, 1984

[54] ELECTRICAL CONNECTION DEVICE FOR HIGH DENSITY CONTACTS

[75] Inventor: Jean Bonnefoy, Crespieres, France

[73] Assignee: Compagnie Internationale pour l'Informatique Cii-Honeywell Bull (Societe Anonyme), Paris, France

[21] Appl. No.: 326,530

[22] Filed: Dec. 2, 1981

[30] Foreign Application Priority Data

Dec. 5, 1980 [FR] France ..... 80 25861

[51] Int. Cl.[3] ..... H01R 23/72

[52] U.S. Cl. ..... 339/17 M; 339/61 M

[58] Field of Search ..... 339/17 LM, 17 CF, 17 M, 339/59 M, 61 M, 255 R, 255 P

[56] References Cited

U.S. PATENT DOCUMENTS

| | | | |
|---|---|---|---|
| 3,215,968 | 11/1965 | Herrmann | 339/17 LM |
| 4,008,300 | 2/1977 | Ponn | 264/104 |
| 4,008,519 | 2/1977 | Gillissen et al. | 29/625 |
| 4,161,346 | 7/1979 | Cherian et al. | 339/17 M |
| 4,176,895 | 12/1977 | Aldridge | 339/17 CF |
| 4,199,209 | 4/1980 | Cherian et al. | 339/59 M |
| 4,202,588 | 5/1980 | Dalamangas et al. | 339/59 M |
| 4,209,799 | 6/1980 | Schierz et al. | 357/81 |
| 4,278,990 | 7/1981 | Fichot | 357/81 |
| 4,344,662 | 8/1982 | Dalamangas et al. | 339/59 M |

FOREIGN PATENT DOCUMENTS

| | | |
|---|---|---|
| 856 | 2/1979 | European Pat. Off. . |
| 2236272 | 1/1975 | France . |
| 2306547 | 10/1976 | France . |
| 2452178 | 10/1980 | France . |
| 881571 | 11/1961 | United Kingdom . |

OTHER PUBLICATIONS

IBM Technical Disclosure, Durand, vol. 21, No. 3, pp. 1064–1065, 8–1978.

*Primary Examiner*—Neil Abrams

*Attorney, Agent, or Firm*—Kerkam, Stowell, Kondracki & Clarke

[57] ABSTRACT

The invention provides an electrical connection device for connecting high density contacts of large scale integrated circuits (LSI) and serves to establish electrical connection between the contact areas (15) of the circuit network (14) on a substrate (11) for supporting integrated circuit devices (12) and the contact pads (18) of a conductor network (17) on a printed circuit card (13). The electric connection device comprises a plurality of conductive elements disposed within a housing (26) extending in a given direction. The conductive elements are electrically insulated one from the other and have contacts which are exposed through slots in the housing to connect to the areas (15) and pads (18). The conductive elements (29) are stacked in the given direction and are formed each with a conductor sheet (30) provided with two contact surfaces (31*a*, 32*a*) elastically movable in a plane normal to the given direction independently of the surfaces of contact of neighboring sheets. The conductor sheet are supported on elastically deformable rolls extending the length of the support means which enable the contact surfaces to be displaced and compensate for deformities in the substrate and manufacturing tolerances.

21 Claims, 13 Drawing Figures

ELECTRICAL CONNECTION DEVICE FOR HIGH DENSITY CONTACTS

CROSS REFERENCE TO RELATED APPLICATIONS

The subject matter of this invention is related to applications for Pat. Ser. No. 326,818 of Jean Bonnefoy and Ser. No. 326,820 of Gerard Dehaine, all filed concurrently herewith and assigned to the assignee of the present invention. The subject matter of said applications are hereby incorporated by reference.

BACKGROUND OF THE INVENTION

1. Field of the Invention

The invention relates to an electrical connection device for high density contacts.

2. Description of the Prior Art

A significant example of high density electric connection of contacts will be seen in reference to the substrates which form supports for integrated circuit devices The face of the substrates which carry the integrated circuit devices include a network of interconnection conductors for these devices and areas of peripheral contact constituting the input and output poles of the substrate. The substrates themselves may be mounted on printed circuit cards provided for their electric interconnection and provided in consequence with contact points destined to cooperate with the respective areas of the substrates, through electric connection devices.

For a classic substrate of square form having for example 46 contact areas on a side with a spacing of about 1 mm and a width of about 0.6 mm, the connection of the contact areas on a side of the substrate to the corresponding contact points or pads of a printed circuit card is made by means of a device put in place beginning with a comb composed of equidistant parallel spikes corresponding to the spacing of the areas and of the contact points or pads. On the side of the substrate, the combs form a clamp clamping the corresponding side of the substrate while making contact, by soldering, with the areas disposed on this side. On the card, the other extremities of the combs are soldered to the contact points or pads, the combs being maintained equidistant by means of an insulating bar or an insulating link. This connection device has the advantage of being flexible, operable and removable, features which are particularly important for this type of connection as will appear from the following.

As integrated circuit devices become more and more dense, for the best benefit of the advantages of large scale integration (LSI) and of the miniaturization resulting from the integrated circuit devices, the conductors of the interconnection network and the areas of contact that comprise a substrate become more and more dense. By way of example, the actual substrates in question are square plates of about 80 mm on a side, comprising 150 contact areas on each side with a spacing of about 0.5 mm and a width of about 0.3 mm. Present electric connection devices available do not assure an electrical and mechanical connection which is dependable, easily removable, relatively flexible and easily reproducible in large numbers. The detachability of connection devices is an essential factor when taking into account the high price of a substrate equipped with a large number of integrated circuit devices. However, the replacement of a failed substrate on a printed circuit card for repair and future reuse should not alter the quality and the reliability of the connection to the areas and contact points, both from the electrical and mechanical points of view. The fineness of the contacts and of the contact points due to the high density of connections and the particularly close spacing in the case of the substrates makes it extremely difficult to successfully detach such devices, particularly if they are fixed by solder. Thus, principally in the area of maintenance, the facility of the spacing of the connection device and its replacement are important considerations and, if possible, replacement should be done without the intervention of costly or encumbering material or apparatus.

Finally, flexibility of the connection device is necessary for the following principal reasons. On the one hand, the substrates are not always flat. For example, the several bakings that they undergo for solidification of the insulating and conductive layers of the interconnection network deposited by serigraphie are susceptible to alter more or less, locally or entirely, their initial flatness. On the other hand, the printed circuit cards are, of large surface since they are conceived to support up to a dozen substrates, and a relative flexibility. Further, the areas of the substrates and the contact points of the cards are not always of regular thickness. Under these conditions, it is necessary that the connection device be sufficiently flexible to establish an efficient connection in spite of the deformations in the substrate surface and of the cards and light variations of dimensions between areas and between contact points which come within the zone of predetermined accepted tolerance.

SUMMARY OF THE INVENTION

The invention has an electric connection device for high density contact arrangements which overcomes the disadvantages of prior art connectors.

An electric connection device embodying the present invention comprises a plurality of stacked conductor elements electrically insulated one from the other and disposed relative to a means of support and extending in a given direction along the length of the support or carrier. Each conductor element is formed by a thin conductive sheet providing two movable elastic contact surfaces in a plane normal to the said direction and substantially independent of the contact surfaces of neighboring thin sheets.

Each thin sheet has an insulating layer on its face, with the exception of the contacts surfaces, so that when stacked the thin sheets can be displaced independently one from the other in a plane perpendicular to the direction of the carrier to provide to the connection device a required flexibility and independence vis-a-vis the defects of the surface of the substrates and of the cards and of the variations of level between points and between areas. Elastic means may be incorporated within the carrier between the stack of elements and interior walls of the carrier to bias the contact surfaces outwardly. The compactness of the connection device which results is aided by the fact that the elastic means can be in the form of two simple bands of rubber retained in the carrier.

BRIEF DESCRIPTION OF THE DRAWINGS

The characteristics and advantages of the invention will appear more clearly in the description which follows with reference to the accompanying drawings. In the drawings.

DESCRIPTION OF THE PREFERRED EMBODIMENTS

Figure 1:
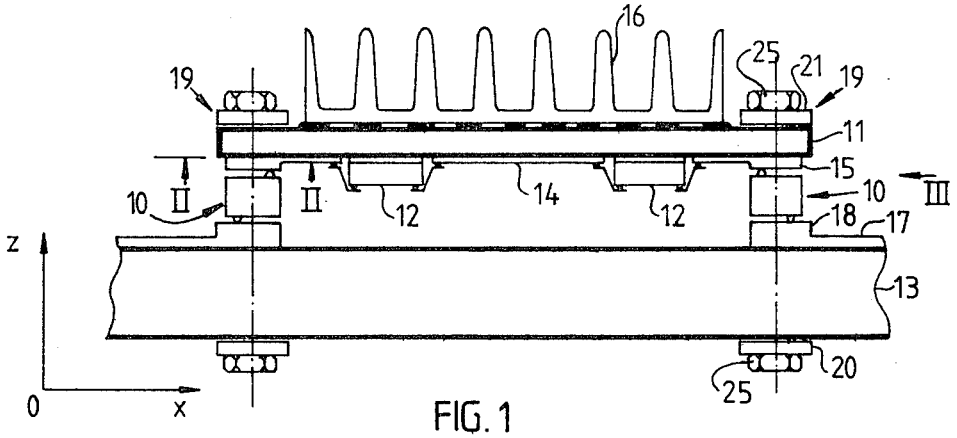
FIG. 1 is a fragmentary schematic view in elevation of a part of a printed circuit card arranged to cooperatively support a substrate supporting integrated circuit device to the intermediary of a connection device embodying the invention.

Referring to FIG. 1, there is shown, by a side schematic view, two electrical connection devices (10) having a high density of contacts embodying the invention and arranged for connecting the electric circuits of a substrate (11) carrying integrated circuit devices (12) to a printed circuit card (13). The card (13) is only shown fragmentarily, being limited to the part supporting the substrate (11), it being understood that in actuality a printed circuit card is able to receive up to about a dozen substrates each supported and connected in the same manner as illustrated in FIG. 1. Further, for clarity of the drawings, the substrate (11) is shown to cooperate with the card (13) only on its two opposed sides which are adjoined in FIG. 1 to the two respective connection devices (10). In reality, each of the four sides of a substrate is connected to the card by a connection device such as (10).

Figure 2:
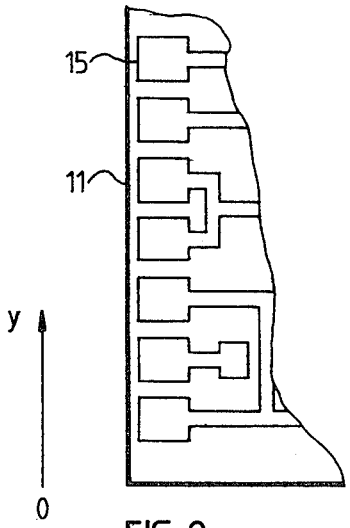
FIG. 2 illustrates schematically in a fragmentary view from above on the line II—II of FIG. 1 an example of the contact points on the surface of the substrate shown in FIG. 1.

As shown in FIGS. 1 and 2, the face of substrate (11) carries the integrated circuit devices (12) and is provided with a network of interconnection conductors (14) reaching to the contact areas (15) generally aligned at the proximity of the edges of the substrate at each side. The other face of the substrate ordinarily receives cooling devices such as, for example, a finned radiator (16) for dissipation of heat produced by the devices (12). A suitable mounting arrangement for such a radiator is described in the aforenoted application Ser. No. 326,820. As for the card (13), the printed circuit (17) that it generally presents on one of its faces comprises contact points or pads (18) disposed to be connected respectively to the contact areas (15) of substrate (11) through the connection devices (10).

Figure 4:
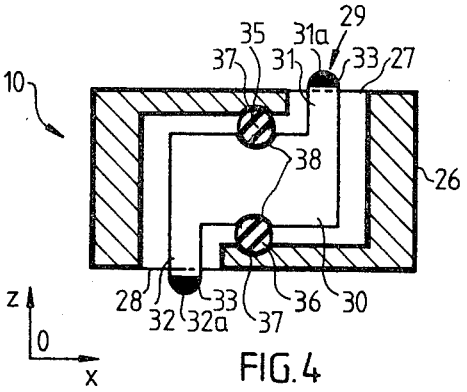
FIG. 4 illustrates by a sectional view in a plane Oxz defined in FIG. 1 an example of a connection device embodying to the invention.

In the embodiment of FIG. 1, the two devices (10) embodying the invention are of a type analogous to that illustrated for example in FIG. 4, that is to say establishing a simple electric connection by contacts under the effect of a pressure. These connection devices are associated with a mechanical clamping device or fixation system of the substrate and of the card which, preferably, will exert uniformly and at the same time the pressure necessary for establishing the proper electric connection. Such a clamping device is described in the aforenoted application Ser. No. 326,818.

Figure 3A:
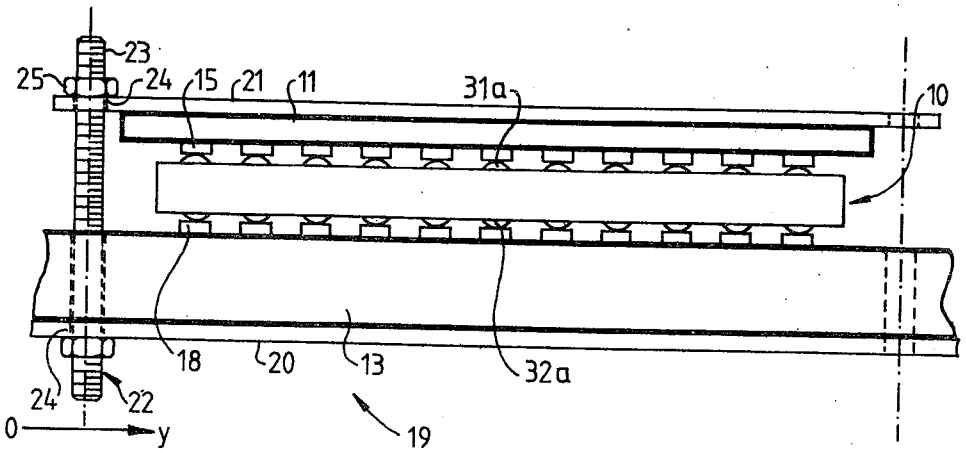
FIG. 3*a* illustrates schematically, as seen from the side in elevation along the arrows III indicated in FIG. 1, the force adjusting means of the connection device embodying the invention.
Figure 3B:
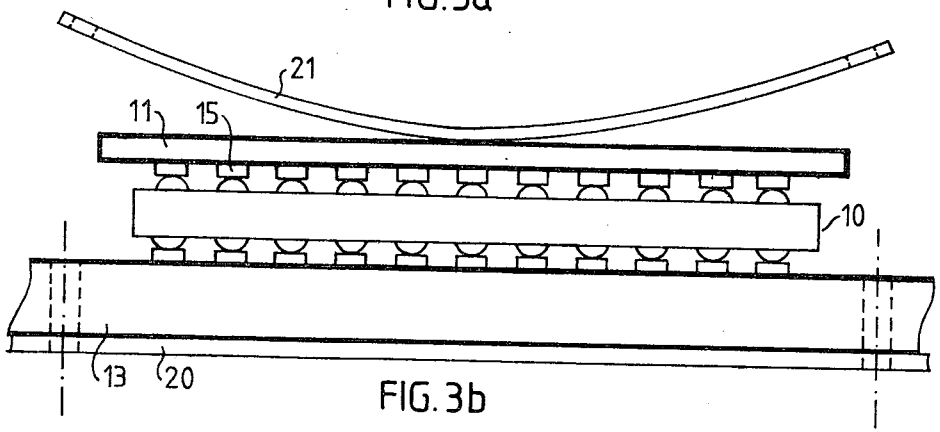
FIG. 3*b* shows the state of the clips of the connecting device illustrated in FIG. 3*a* before mounting or after demounting of the clip or release of the force adjusting means.

In accordance with the example illustrated in FIGS. 1, 3*a* and 3*b*, the two fixation systems (19) relative to the two electric connection devices (10) are clamping systems constituted essentially by two rectilinear clips (20, 21) cooperating respectively with the card (13) and the substrate (11) while clamping a connection device (10) by means of two fixation members (22) disposed at the two respective extremities of the clips (20, 21). In accordance with the example illustrated in FIG. 3*a*, the fixation members 22 are composed each of a threaded bolt (23) passing through openings (24) in the extremities of the clips (20, 21) and comprising at each end clamping nuts (25). In the case where the pressure exerted on the contacts of the connecting device (10) should be relatively constant over the length of a side of the substrate (11), it will be advantageous to use the system (19) in which at least one of the clips (20, 21), takes, in position of repose, the form illustrated by the sheet 21 in FIG. 3*b* and described more in detail in the aforenoted application for Pat. Ser. No. 326,818. In brief, the form taken in repose by the clip 21 is substantially equivalent to the elastic deformation of an initially straight beam of uniform section and of the same length as the clip (21), mounted on two simple spaced supports of this length, that is the length which separates the two threaded bolts (23) in the example of FIG. 3*a*, and uniformly loaded over this length, the clamping force supplied to each extremity of the clip (21) corresponding substantially to one half of the load uniformly distributed on this beam. The form of the clip is that of a catenary curve.

Further, with reference to FIGS. 1 and 2, an orthogonal reference system Oxyz has been defined to facilitate the presentation of the figures.

FIG. 4 illustrates a first example of a connection device (10) embodying the invention, seen in section in the plane Oxz. In FIG. 4 the device (10) illustrated comprises a sheath or carrier (26) of rectangular parallelepipedic form extending along the axis Oy and having two openings (27, 28) in the two opposite walls of the sheath (26) along the direction Oy. The openings are disposed respectively, to face opposite the contact areas (15) of the substrate (11) and the contact points (18) of the card (13) of FIG. 1.

In the sheath or carrier (26) are stacked, along the axis Oy direction, a plurality of conductor elements (29) electrically insulated from each other. With references to FIGS. 4 and 5*a*, it will be seen that each element (29) comprises a conductive sheet (30) provided with two outwardly extending contacts (31, 32) terminating in two contact surfaces (31*a*, 32*a*) which emerge at least partially from the respective openings (27, 28) of the carrier (26) in the plane of the corresponding sheet (30). Preferably, the contact surfaces (31*a*, 32*a*) carry a gilding (33) or an analogous coating facilitating electric contact. Each element (30) may be said to be Z-shaped, having a central trunk portion (30') and two oppositely extending contact arms (31, 32).

Figures 5A, 5B:
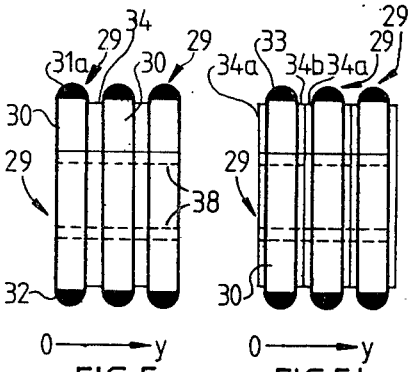
FIG. 5*a* illustrates by a side view along the axis Ox defined in FIG. 1 a manner of stacking the elements contained in the connection device represented in FIG. 4.
FIG. 5*b* is a similar view with the separating sheet 34 made up of multiple layers.

The sheets (30) are separated from each other by electrical insulating elements (34). These elements can be insulating sheets or, advantageously, layers disposed exactly on at least a face of the sheets (30). In the example of FIG. 5*a*, the elements (34) are insulating layers deposited on one face only of each conductive sheet (30), and cover the entire surface of the sheet up to the area of the gilding (33).

In accordance with the embodiment seen in FIG. 5*b*, the two faces of each sheet each comprise at least partially a layer of insulation (34*a*, 34*b*). Each insulating element (34), which separates two conductive sheets (30) adjacent each other, is then composed of the two insulating layers (34*a* and 34*b*) which are respectively integral with the two faces of the conductive sheet (30) which are opposed. Thus, each element (29) is composed of a plurality of sheets (30) and its two insulating layers (34*a* and 34*b*) stacked along the longitudinal axis of the carrier (26).

In accordance with another feature of the invention, elastic means are incorporated between the inner walls of the sheath or carrier (26) and the stack of elements (29) to urge the surfaces of contact (31*a*, 32*a*) of the sheets (30) toward the exterior of the sheath through the respective openings (27, 28). In accordance with the example described in FIG. 4, these elastic means are formed by two cylindrical rolls (35, 36) made of flexible material such as rubber. These two rolls extend parallel to the openings (27, 28) and are maintained in position by grooves (37) formed in the surface of the internal walls of the sheath (26) and corresponding grooves (38) in the lateral walls of the sheets (30) and in the insulating elements (34), as illustrated. As shown in FIG. 4, the grooves (37) are disposed opposite each other in oppositely facing walls.

Figure 6:
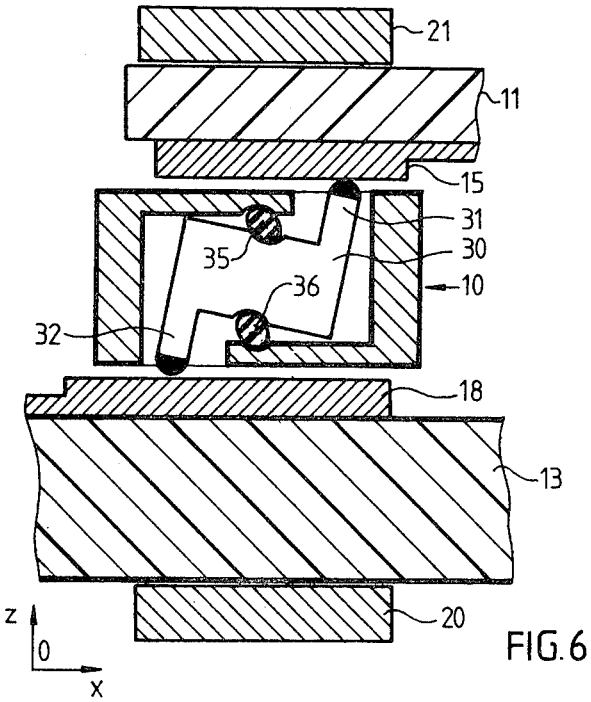
FIG. 6 illustrates in sectional view in a plane Oxz, the device represented in FIG. 4 positioned to connect a substrate to a printed circuit card in the manner indicated in FIG. 1.

FIG. 6 shows the connection device (10) illustrated in FIG. 4 when it is clamped, in manner analogous to FIG. 1, between the contact areas (15) of a substrate (11) and the contact points or pads (18) of a card (13) by means of a clamping device (19) having two clips (20, 21) similar to that seen in FIGS. 3*a* and 3*b*. It will be seen from FIG. 6 that the conductive sheets (30) bend or pivot about rolls (35) or (36) more or less to establish themselves in fixed contact positions, as illustrated, so as to exercise respectively on the contact areas (15) and the contact points (18) the action forces produced by the elastic rolls (35, 36) in opposition to the clamping force exercised by the clips (20 and 21). In accordance with the clamping force and the variable thicknesses between the contact areas (15) and between the contact points (18), each sheet (30) will rotate slightly about an axis parallel to the axis of the carrier. From the fact that the elements (29) are stacked, they rotate independently one from the other by simple friction between an insulating layer (34) and a sheet (30) and the following sheet (30) in the example of FIG. 5*a* and between the two insulating adjacent layers (34*a*, 34*b*) of two successive sheets (30) in the example of FIG. 5*b*.

Another advantage of the use of a device in accordance with the invention is found in the fact that the pivoting or rotation of the sheets causes the contact surfaces (31*a*, 32*a*) to wipe against the surface (15) and the contact point (18). This wiping action produces an automatic cleaning effect assuring a clean connection between the elements in contact. Further, because of the stacking of the elements (29) in the sheath or carrier (26) and the presence of the rolls (35 and 36) and in the case where the carrier is sufficiently flexible, the sheet (30) can be subjected to a slight distortion around the axis Oy to compensate for distortions in the form of the surfaces of substrate (11) and of the card (13), without changing the quality of the connection. In addition, the device (10) can tolerate slight deformations in the direction Oz which, in practice, will not affect the quality of the connection. Further, the device (10) can support internally practically the entire surface of the stacked sheets, with the exception of the contact surfaces (31*a* and 32*a*) of the sheets (30) which are exposed. These can be made very thin, while still providing the contact surface having the required rigidity, which is moreover generally accomplished by gilding of contact (33). It follows that a connection device conforming to the invention can be very well adapted to an electric connection of high density contacts such as the density given by way of example in the first part of this description (areas and points of 0.3 mm, placed 0.5 mm).

The clamping of the clips (20 and 21) is adjusted to provide a given force, 100 grams for example, on each surface of contact (31*a* and 32*a*) of a sheet (30), to provide an efficient contact of good quality between the sheets and the surfaces and corresponding points. Thanks to the system of clamping illustrated in FIG. 3*b*, it is seen that this pressure can be uniformly distributed on all of the contacts of the device. The pressure received by the surfaces of contact (31*a* and 32*a*) of each sheet (30) is transmitted by the rolls (35 and 36) to the corresponding walls of the sheath (26) of the device (10). It will be noted however that with a density of contacts per unit of length given above by way of example, the application of a pressure of 100 grams per contact leads to the use of a total pressure of 2 kilos per cm of carrier along the axis Oy. The transmission of this pressure to the walls of the carrier thus risks the modification of the form of these walls and could affect the quality of the electrical contact established. The disposition of the rolls (35 and 36) which is illustrated in FIGS. 4 and 6 is advantageous in that a deformation of the upper and lower walls of the sheath or carrier (26) will be limited by the surfaces (15) and the points (18) submitted to the opposite clamping pressure. However, the arrangement of the elastic means in the sheath or carrier of a device conforming to the invention can be different from that which has just been described.

Figure 7:
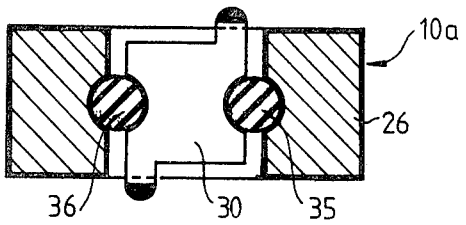
FIG. 7 illustrates, by a view analogous to that of FIG. 4, another embodiment of the connection device conforming to the invention.

FIG. 7 shows an arrangement conforming to the invention (10*a*), in all points similar to that of the FIG. 4, with the exception of the arrangement of the rolls (35 and 36) on the lateral walls of the sheath (26) rather than the upper and lower walls. The arrangement (10*a*) can thus allow for walls which are thicker than the arrangement (10) seen in FIG. 4. Generally, the lateral walls of the sheath should be sufficiently thick to resist the pressure transmitted by the surfaces of contact (31*a* and 32*a*) of the sheets (30) of the device.

Figure 8:
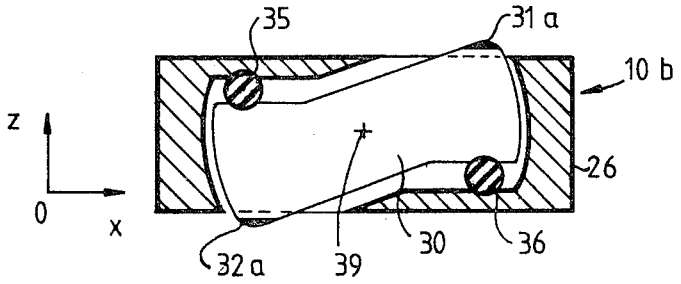
FIG. 8 illustrates, by a view analogous to that of FIG. 4, further embodiment of a device embodying the invention.

FIG. 8 illustrates, in an analogous way to FIGS. 4 and 7, a variant of the embodiment of the connection device conforming to the invention. In FIG. 8, the arrangement (10*b*) has a structure similar to that of FIG. 4, so that its elements are identified by the same numbers as those indicated in FIG. 4. In this arrangement (10*b*), the lateral sides of the sheets (30) (along the axis Ox) are segments of a circle with center 39 being disposed as shown interior of the sheath or carrier 26. The lateral sides cooperate with the interior lateral faces of the sheath (26), equally conformed in segments of concentric circles. On the other hand, the sheets are substantially rectangular and their surfaces of contact (31 and 32) are two summits of the sheets in lieu of being the extremities of extensions as in device (10). It follows that the arrangement (10*b*) can be more compact and stronger than the arrangement (10). Further, because of the arc form of the concentric circles of the lateral edges of the sheets (30) and of the sheath (26), the sheets pivot around center (39) whereby the deformations of the elastic elements (the rolls 35 and 36) occur practically only in the direction of the axis Oz in the example of FIG. 8, while in the arrangement (10) of FIG. 6, the deformations are the result of two components along Ox and Oz.

Figure 9:
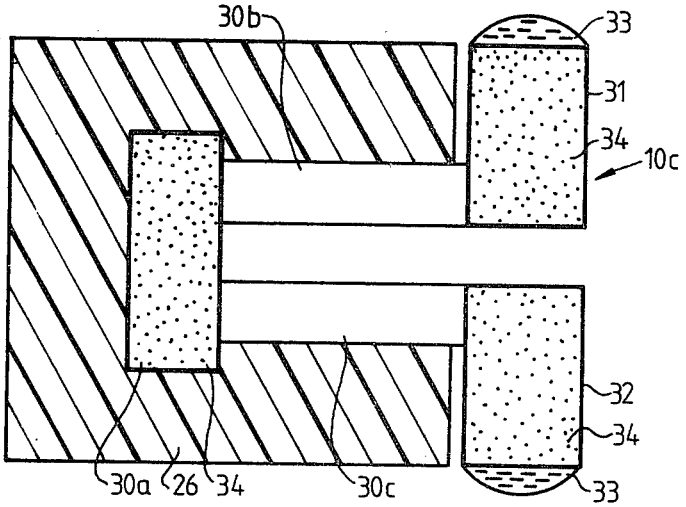
FIG. 9 illustrates, by a view analogous to that of FIG. 4, a third embodiment of a device embodying the invention.

FIG. 9 illustrates another embodiment of a connection device conforming to the invention. In the device (10*c*) shown in FIG. 9, the sheets (30) each comprise a base (30*a*), two branches or arms (30*b*, 30*c*) and two contact extensions (31, 32). The base (30*a*) is fixed to the sheath (26) and is provided with an insulating layer (34); the branches (30*b* and 30*c*) are perpendicular extensions of the base (30*a*) which, in the example illustrated, may be spring members that bear on the sheath (26) without being fixed thereto. Contact extensions (31 and 32) are perpendicular extensions of the branches (30*b*, 30*c*). Their respective contact surfaces (31*a*, 32*a*) are coated with the gilt contact (33), while the remaining surface of at least one of their lateral face has an insulation layer (34). Further, the elastic means are constituted by the branches (30*b* and 30*c*) of the sheets (30) which, by bending, will adapt to the slight displacement to which the surfaces of contact (31 and 32) are subjected during the clamping of the surfaces and the points as in the case of FIG. 6.

Figure 10:
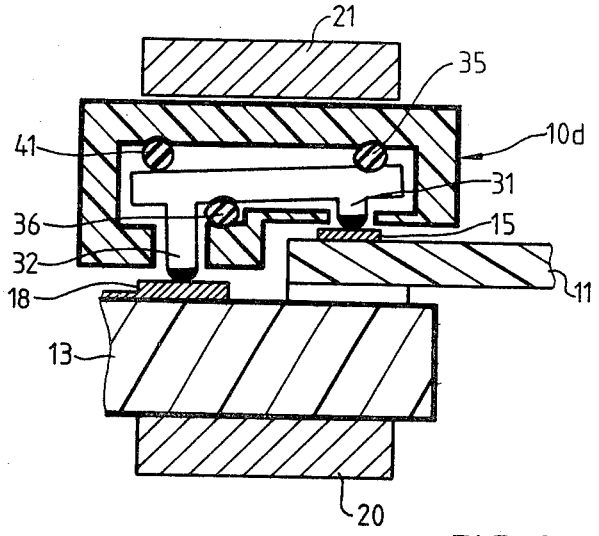
FIG. 10 illustrates in a view analogous to that of FIG. 6 still another embodiment of a device conforming to the invention and adapted to a mode of connection other than that represented in FIG. 1 and, FIG. 11 illustrates, by a view analogous to that of FIG. 4, an embodiment of the device represented in FIG. 9 adapted to establish a connection on the areas of the substrate by soldering and on the points of the printed circuit card by contact.

FIG. 10 illustrates, in a manner analogous to that of FIG. 6, a further embodiment (10*d*) of a device conforming to the invention connecting the contact areas (15) of a substrate (11) to the contact points (18) of a card (13), the area (15) and the point (18) being located side by side and no longer opposite or superimposed as in the case corresponding to the FIGS. 1 to 9. In spite of the total change of the device of the areas and of the points, it will be noted that the device (10*d*) presents much similarity with the device (10) and distinguishes principally from it by the fact that the contact extensions (31 and 32) are disposed on the same side of the sheath (26) and extend through openings formed by parallel slots in the sheath. The elastic elements are constituted by three rolls (35, 36 and 41). The clamping clip (21) of a clamping system analogous to that of FIG. 3*b* is then directly applied on the outer top wall of the sheath (26) which is opposite to the wall through which the contact surfaces (31*a* and 32*a*) extend, that is, the wall having the parallel slots.

As shown in FIG. 10, elastic roll (36) is disposed in an appropriate seat or groove located in an intermediate section of the sheath between the two prallel slots, while the other two rolls (35) and (41) are disposed between the sheet (30) and the internal wall of the sheath or carrier (26), to the outside of contact extensions (31, 32) adjacent the outer edges of the sheet.

Figure 11:
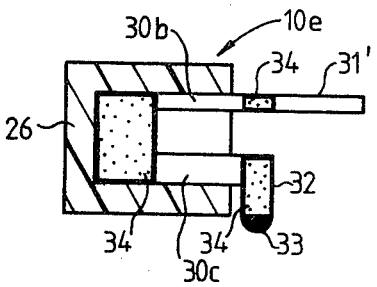

Finally, FIG. 11 illustrates an embodiment (10*e*) of a device conforming to the invention offering the opportunity of having on one side a solder connection and on the other side a connection by mechanical contact. The embodiment illustrated in FIG. 11 is similar to the arrangement (10*c*) represented in FIG. 9, the difference between the devices (10*c*) and (10*e*) residing essentially in that the contact extension (31), which is designed to come into contact with a surface (15) of a substrate (11) extends, in the device (10*e*) from the branch (30*b*) outwardly to form an extension (31') adapted to be soldered on a surface of a substrate. As illustrated, the extension (31') can include an insulating layer (34) to provide at the same time electric insulation between the adjacent extensions (31') and a uniform displacement between them.

The foregoing embodiments are given by way of illustration and not limitation and resort should be made to the appended claims for a realization of the full scope of the invention which includes the various modifications and changes which will readily suggest themselves to those skilled in the art.

I claim:

1. An electrical connection device for connecting a first plurality of electrical terminals to corresponding second electrical terminals, the device comprising a housing extending in a predetermined direction, and a plurality of rigid conductor elements having first and second contact surfaces, the conductor elements being supported within the housing by elastically deformable means so as to enable the conductor elements to pivot independently, one from the other, in a plane substantially normal to said predetermined direction, the elastically deformable means biasing the conductor elements to a terminal-contacting position at which the first and second contact surfaces respectively contact corresponding first and second terminals.

2. A device in accordance with claim 1, wherein the conductor elements comprise planar conducting sheets disposed in parallel stacked relationship to one another within the housing.

3. A device in accordance with claim 2, wherein the housing has an elongated parallelepiped form with openings in two opposite sidewalls for the first and second contact surfaces, the contact surface being offset with respect to each other in said plane.

4. A device in accordance with claim 2 wherein the conducting sheets are separated from each other by insulating layers.

5. A device as described in claim 4, wherein the conductor sheets each include an insulating layer on at least one of their faces.

6. A device in accordance with claim 1, wherein the conducton elements are substantially rectangular, each having two summits constituting the said contact surfaces.

7. A device in accordance with claim 1, wherein the conductor elements each have two extensions of which the extermities constitute said contact surfaces.

8. A device in accordance with claim 1 wherein one of the contact surfaces is a surface adapted to be connected to a terminal by soldering.

9. A device in accordance with claim 1, wherein the elastically deformable means comprises first and second substantially cylindrical elastic members extending in said predetermined direction, each elastic member being positioned in a groove in an internal surface of a wall of the housing and in a corresponding groove in the conductor elements.

10. A device in accordance with claim 9, wherein the elastic members are disposed in grooves in opposite walls of the housing and in opposite sides of the conductor elements.

11. A device in accordance with claim 1, wherein the contact surface project from opposite sides of the housing, and wherein the device further comprises clamp means for clamping the housing between the first and second terminals with the contact surfaces engaging the terminals.

12. A device in accordance with claim 11, wherein, upon clamping the holding between the first and second terminals, the conductor elements pivot against the bias of the elastically deformable means to exert pressure on the terminals and so as to compensate for variations in the distance between the first and second terminals.

13. A device in accordance with claim 12, wherein the elastic members are positioned within the housing so as to be compressed between the walls of the housing and the conductor elements upon pivoting of the conductor elements.

14. A device in accordance with claim 13, wherein the elastic members are positioned within the housing such that upon pivoting of the conductor elements forces are exerted on each elastic member in two different directions within said plane.

15. For connecting contact areas of an integrated circuit substrate provided with an interconnection network and integrated circuit devices to corresponding contact points on a printed circuit card, a connection device comprising support means extending in a predetermined direction, a plurality of rigid conductor elements having first and second contact surfaces for respectively contacting a contact area and a corresponding contact point, the conductor elements being supported on the support means by elastically deformable means so as to enable the conductor elements to pivot independently, one from the other, in a plane substantially normal to said predetermined direction, the elastically deformable means biasing the conductor elements to a contacting position, and clamping means for clamping the support means between the substrate and the printed circuit card such that the contact surfaces engage the contact areas and contact points to provide an electrical connection therebetween.

16. A device in accordance with claim 15, wherein the elastically deformable means comprises first and second substantially cylindrical elastic member which engage the support means and engage the conductor elements on opposite sides thereof.

17. A device as set forth in claim 15 wherein the conductor elements comprise planar conducting sheets separated from each other by insulating sheets.

18. A device as set forth in claim 17, wherein the conductor sheets each include an insulating layer on at least one of their faces.

19. A device as set forth in claim 17, wherein the conducting sheets are substantially rectangular, each having two summits constituting the said contact surfaces, the two summits being disposed on opposite sides of the sheet and offset with respect to a point about which the sheet pivots.

20. A device as set forth in claim 17 wherein the conducting sheets comprise two extensions of which the extremities constitute the said contact surfaces.

21. A device as set forth in claim 15 wherein one of the contact surfaces is adapted to be connected to a conductor by soldering.

* * * * *

UNITED STATES PATENT AND TRADEMARK OFFICE

CERTIFICATE OF CORRECTION

PATENT NO. : 4,445,735

DATED : May 1, 1984

INVENTOR(S) : Jean Bonnefoy

It is certified that error appears in the above-identified patent and that said Letters Patent is hereby corrected as shown below:

In Column 8, line 63 delete "conducton" and insert --conductor--.

In Column 9, line 16 delete "surface" and insert --surfaces--.

In Column 9, line 22 delete "holding" and insert --housing--.

In Column 9, line 26 delete "distance" and insert --distances--.

In Column 10, line 18 delete "member" and insert --members--.

Signed and Sealed this

*Fifteenth* Day of *January 1985*

[SEAL]

*Attest:*

*Attesting Officer*

GERALD J. MOSSINGHOFF

*Commissioner of Patents and Trademarks*